US005197921A

United States Patent [19]

De Lank et al.

[11] Patent Number: 5,197,921

[45] Date of Patent: Mar. 30, 1993

[54] CONSTRUCTION ELEMENT FOR A NOISE-SUPPRESSION SHED

[75] Inventors: Gerd De Lank, Heddesheim; Klaus-Peter Lubien etzki, Dossenheim, both of Fed. Rep. of Germany

[73] Assignee: Werner Genest und Partner Ingenieurgesellschaft mbH, Ludwigshafen am Rhein, Fed. Rep. of Germany

[21] Appl. No.: 676,551

[22] Filed: Mar. 28, 1991

[30] Foreign Application Priority Data

Mar. 30, 1990 [DE] Fed. Rep. of Germany ..... 4010329

[51] Int. Cl.[5] ..... F24F 7/02

[52] U.S. Cl. ..... 454/254; 52/18; 181/211; 454/250; 454/906

[58] Field of Search ..... 52/18; 181/285, 286, 181/211, 224, 245; 454/237, 250, 254, 277, 281, 282, 364, 365, 339, 906

[56] References Cited

U.S. PATENT DOCUMENTS

| | | | |
|---|---|---|---|
| 856,117 | 6/1907 | Waldimire | 454/339 X |
| 1,347,669 | 7/1920 | Ballinger et al. | 52/18 |
| 2,308,766 | 1/1943 | Martinus | 454/277 X |
| 2,704,504 | 3/1955 | Wilkening | 181/224 X |
| 3,875,901 | 4/1975 | Erickson et al. | 454/339 X |
| 3,978,635 | 9/1976 | Theault | 52/18 X |

FOREIGN PATENT DOCUMENTS

| | | | |
|---|---|---|---|
| 714114 | 3/1942 | Fed. Rep. of Germany | 52/18 |
| 1684688 | 1/1971 | Fed. Rep. of Germany . | |

*Primary Examiner*—Harold Joyce
*Attorney, Agent, or Firm*—Finnegan, Henderson, Farabow, Garrett & Dunner

[57] ABSTRACT

A construction element for a noise-suppression shed of the type used for ground-testing jet engine aircraft. These sheds usually have transversely extending continuous apertures for the admission of fresh air, the inner face of the shed's roof being provided with spaced liners of a sound-absorbing material defining flowpaths for fresh air entering the interior of the shed. The element comprises a cover panel element carried by a mounting structure and having a stepped profile configuration in the longitudinal direction of the shed, and mutually spaced first and second elements of a sound-absorbing material. The arrangement of a plurality of construction elements in rows extending in the longitudinal and transverse directions and interconnection of the respective mounting structures results in the formation of continuous air inlet gaps extending over the full width of the roof and passing between the sound-absorbing liners.

22 Claims, 3 Drawing Sheets

CONSTRUCTION ELEMENT FOR A NOISE-SUPPRESSION SHED

BACKGROUND OF THE INVENTION

This invention relates to a construction element for a noise-suppression shed having a plurality of fresh-air inlet apertures distributed over the length of the shed's roof and extending in the transverse direction of the shed: The inner face of the shed's roof is provided with a plurality of discontinuous liners of a sound-absorbing material spaced from one another so as to define respective fresh-air passage gaps communicating with the apertures.

Noise-suppression sheds of this type are used for ground-testing jet-engine aircraft. The front side of such a shed is usually provided with sliding gates extending over the full width of the shed, while the rear wall comprises a baffle arrangement acting as exhaust noise dampening means. The named apertures in the shed's roof and the associated liners of sound-absorbing material are devised for distributing the fresh-air supply over the entire area of the shed's roof, so that the fresh-air intake conditions within the shed, which has a considerable volume in accordance with the dimensions of the aircraft, substantially correspond to the air intake conditions in the open, and for additionally achieving the desired noise suppression.

A noise-suppression shed of the type defined above is known from DE Patent 1,684,688. The operation of erecting a shed of this type with apertures extending transversely of its roof and noise-dampening components disposed therebelow requires high construction investment.

It is an object of the present invention to provide a construction element for a noise-suppression shed which permits the noise-suppression shed to be erected with reduced construction investment and cost as compared to the shed known from the cited patent specification.

SUMMARY OF THE INVENTION

The construction element according to the present invention is characterized in that it comprises a cover panel element carried by a mounting structure and having its opposite margin portions extending in the longitudinal direction of the shed designed so as to overlap corresponding margin portions of adjacent construction elements to define fresh-air inlet gaps therebetween, that the named liners are formed by elements of a sound-absorbing material carried by the mounting structure and/or by the cover panel element and spaced from on another so as to define at least one air passage gap communicating with a respective inlet gap and opening towards the interior of the shed, and that the mounting structure is adapted to have further similar construction elements connected thereto both in the transverse and the longitudinal directions.

This solution according to the invention, which provides the employ of construction elements equipped with elements of a sound-absorbing material cooperating with one another in the assembled state to define noise-dampening fresh-air passage gaps, results in the air inlet and noise dampening system of the shed being fully completed as the preferably prefabricated construction elements according to the invention are being assembled, permitting noise-suppression sheds to be erected in a highly efficient manner and at reduced cost.

The overlapping arrangement of the cover panel elements results in the inlet gaps defined therebetween being protected from precipitation. In the case of the noise-suppression shed known from DE Patent 1,684,688, the apertures in the shed's roof had to be covered by the provision of a separate weatherproofing.

In a preferred embodiment of the invention, the cover panel element includes a lower step section, an intermediate section, and an upper step section extending respectively in the longitudinal direction of the shed, the upper step section extending in a plane parallel to the lower step section, while the intermediate section extends at an oblique angle relative to the lower or/and upper step section. The cover panel element is composed of a roofing element formed by a shaped metal sheet preferably having a trapezoidal profile, and a carrier frame supporting the roofing element.

The first or/and second element made of a sound-absorbing material preferably has at least its side facing the air passage gap covered by a perforate metal sheet acting to hold the element together.

In a still further improved embodiment of the invention, the lower step section of the cover panel element may have a rain gutter formed therein. A thus formed rain gutter is advantageously effective to prevent moisture from flowing over the overlapped end margin of the cover panel element and into the shed's interior.

BRIEF DESCRIPTION OF THE DRAWINGS

Embodiments of the invention shall now be described in more detail by way of example with reference to the accompanying drawings, wherein.

DETAILED DESCRIPTION OF THE INVENTION

Figure 1:
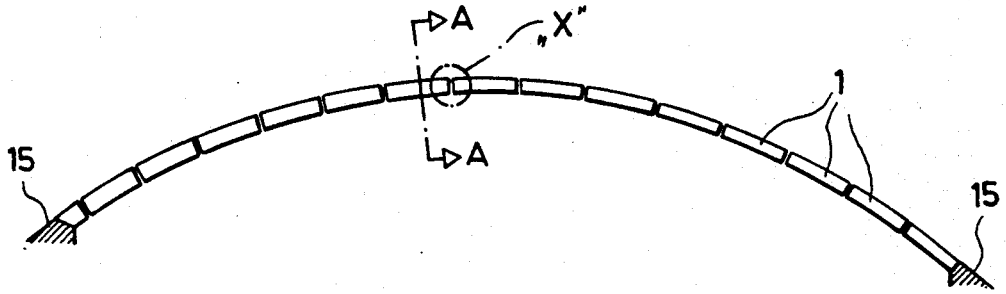
FIG. 1 shows a diagrammatic sectional view, taken across a noise-suppression shed, of the roof of the shed composed of construction elements according to the invention.

Designated by reference numeral 1 in FIG. 1 are construction elements of a noise-suppression shed, disposed in rows in the transverse direction of the shed and angularly connected to one another so as to form a vaulted shed roof extending downwards on opposite sides to join respective foundations 15. This configuration of the shed results in extremely short air supply flowpaths and thus in a very uniform aeration of the interior volume of the shed throughout.

Figure 2:
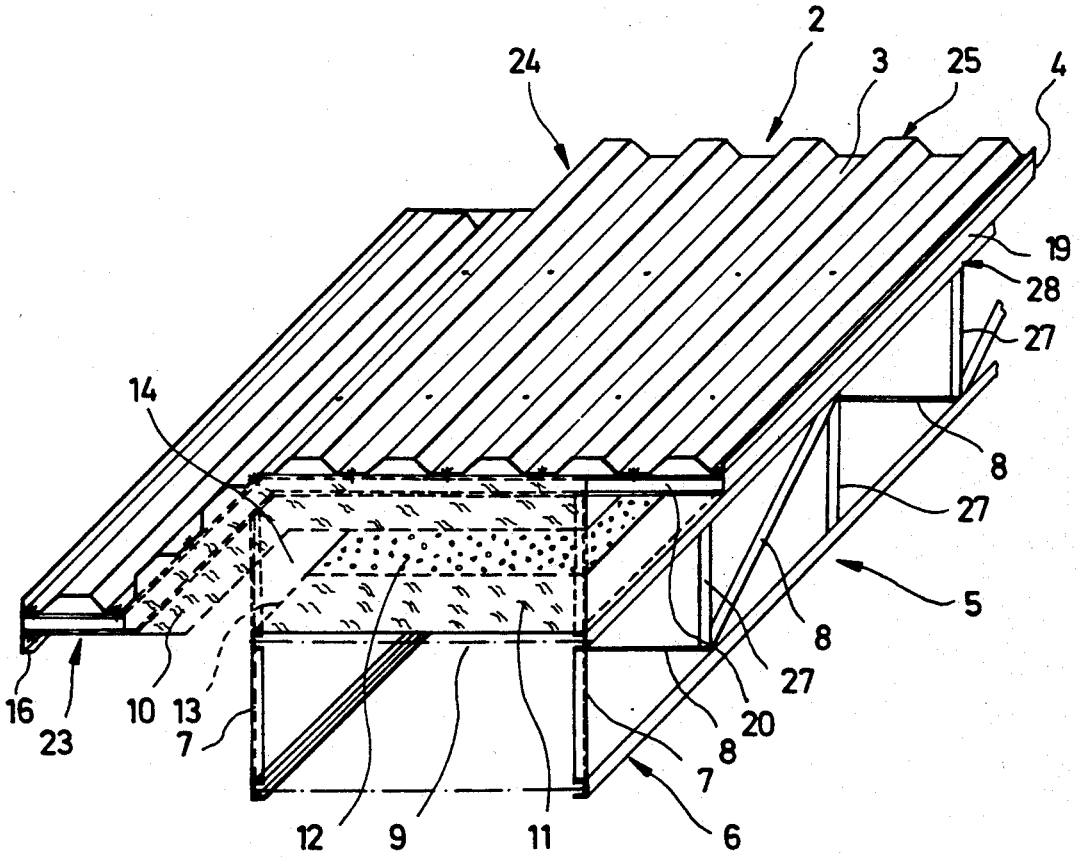
FIG. 2 shows a perspective view of a construction element according to the invention, partially in section along the line A—A in FIG. 1.

The embodiment of a construction element shown by way of example in FIG. 2 is provided with a cover panel element 2 comprising a roofing element 3 supported by a carrier frame 4. In the example shown, roofing element 3 consists of a twice bent metal sheet, specifically a shaped metal sheet having a trapezoid profile. The thus bent metal sheet is secured to frame 4, for instance by threaded fasteners. In addition to peripheral frame members, of which frame members 19 and 20 are visible in FIG. 2, frame 4 comprises a number of further longitudinal and transverse frame members not visible in FIG. 2. Carrier frame 4 is of a stepped configuration corresponding to the bent shape of the metal sheet acting as roofing element 3. Cover panel element 2 is thus composed of a lower step section 23, an intermediate section 24, and an upper step section 25. From lower step section 23, intermediate section 24 extends obliquely upwards to upper step section 25, the latter extending in a plane parallel to lower step section 23. Secured to the free end margin of lower step section 23 underneath carrier frame 4 is a shaped bar 16 extending over the full length of lower step section 23.

Cover panel element 2 is connected to a mounting structure generally indicated at 5 and having a base member in the form of a rectangular frame 6. The peripheral frame members of rectangular frame 6 are preferably formed of U-section bars and support vertically extending stays 7 connected to carrier frame 4 at their upper ends. In the present embodiment, mounting structure 5 is reinforced by an intermediate frame 9 disposed at about half the height of stays 7 and connected thereto at its corners. It would also be possible to provide stays 7 extending just to the level of intermediate frame 9, and additional stays extending between intermediate frame 9 and carrier frame 4 and secured to the latter at their upper ends. The mounting structure 5 is additionally reinforced by oblique struts 8 extending from rectangular frame 6 to intermediate frame 9, and further struts 27 extending perpendicular to the two frames. Similar struts not shown in FIG. 2 are provided at the side of rectangular frame 6 and intermediate frame 9, respectively, opposite struts 8 and 27. The intermediate frame is provided with additional transverse reinforcements not visible in FIG. 2. The mounting structure may advantageously be formed as a welded construction, or the various structural members may be interconnected by screws or bolts. In the present embodiment, mounting structure 5 extends from the boundary between intermediate section 24 of cover panel element 2 and upper step section 25 thereof over part of the length of the latter, so that a free end margin 28 of upper step section 25 projects beyond mounting structure 5.

Indicated at 10 in FIG. 2 is a first element of a sound-absorbing material disposed in contact with the side of cover panel element 2 facing towards mounting structure 5, and supported by carrier frame 4 of cover panel element 2 and/or by mounting structure 5. in the present embodiment, first element 10 extends in the longitudinal direction of the shed substantially over the full length of intermediate section 24 of cover panel element 2, and, at an angle thereto corresponding to the angularly stepped shape of the cover panel element, and in contact with upper step section 25 of cover panel element, substantially over the length of mounting structure 5. Disposed opposite first element 10 and substantially supported by intermediate frame 9 is a second element 11 of a sound-absorbing material extending substantially over the length of the intermediate frame. The marginal edge of second element 11 facing towards intermediate section 24 of cover panel element 2 and the section of first element 10 held in contact therewith is chamfered in accordance with the inclination of intermediate section 24, resulting in the formation of an inclined surface 13 extending substantially parallel to the surface of the respective section of first element 10. First and second sound-absorbing elements 10 and 11 are thus mounted at a uniform spacing therebetween, resulting in their defining an open space 14 for fresh air to pass therethrough. Element 11 is covered by a perforated metal sheet 12 acting to stabilize element 11 and effective to improve its sound-absorption properties. Similar perforated metal sheet covers, not shown in FIG. 2, are also provided on the bottom side of element 11 and on the surface of first sound-absorbing element 10 facing towards second element 11.

Figure 3:
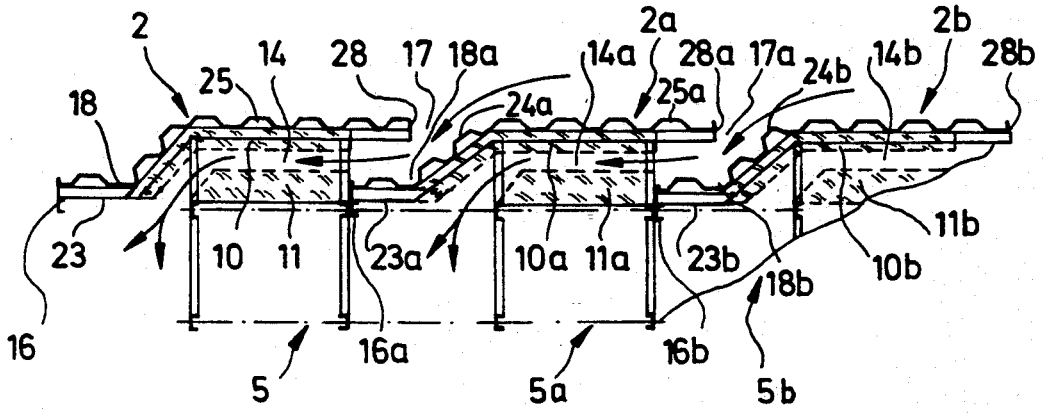
FIG. 3 shows a number of construction elements according to the invention corresponding to the construction element of FIG. 2 and disposed one behind the other in the longitudinal direction of a shed.
Figure 4:
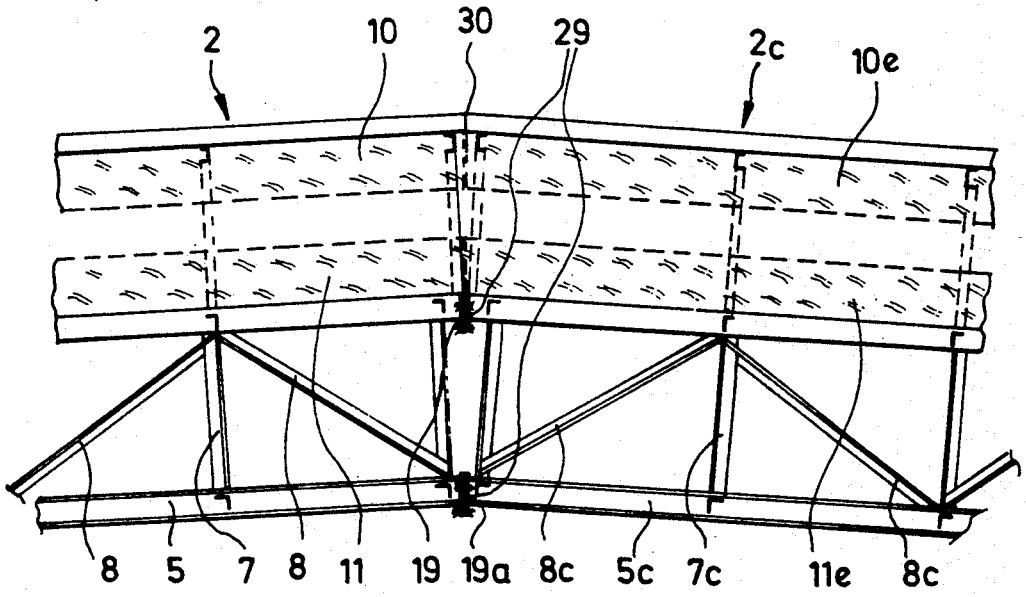
FIG. 4 shows the abutment in the transverse direction of the shed of two elements according to the invention, corresponding to the detail denoted at "X" in FIG. 1.

Shown in FIGS. 3 and 4 is the manner in which construction elements of the type shown in FIG. 2 are interconnected to form the roof of a shed. In these figures, the various structural elements corresponding to those shown in FIG. 2 are designated by the same reference numerals supplemented by indices a-c. FIG. 3 shows parts of a shed's roof in a sectional view taken in the longitudinal direction of the shed. As seen in this figure, the construction elements succeeding one another in the longitudinal direction of the shed are interconnected by securing, preferably by means of threaded fasteners, the shaped bars 16, 16*a*, 16*b* mounted on the free end margin of lower step section 23, to the opposite side of the mounting structure of the adjacent construction element. The upper and lower step sections 25 and 23, respectively, of the interconnected construction elements are aligned in respective planes. Respective fresh-air inlet gaps 17, 17*a* are defined between the free end margins 28, 28*a* of upper step sections 25 and the intermediate sections 24*a*, 24*b* of the adjacent construction elements. The overlapping portions of the cover panel elements of two adjacent construction elements thus define a fresh-air flowpath, in continuance of which a fresh-air passage gap is defined between first and second sound-absorbing elements 10 and 11, respectively, of the adjacent construction element, the thus formed fresh-air inlet flow-path permitting fresh air to enter the noise-suppression shed as indicated by the arrows in FIG. 3. The free end portions 28, 28*a* of upper step sections 25, 25*a* of cover panel elements 2, 2*a* projecting in the longitudinal direction of the shed above the lower step portions 23*a*, 23*b* of the adjacent construction elements act as an effective weather protection preventing precipitation from directly entering the shed. On lower step sections 23 of each cover panel element, the trapezoidal corrugations of the sheet metal roofing elements define respective rain gutters 18–18*b* effective to prevent the flow of moisture towards and into the second sound-absorbing elements 11 of the adjacent construction element.

Indicated at 29 in FIG. 4 are connection points whereat two adjacent construction elements are connected to one another, preferably by means of threaded fasteners, in the transverse direction of the shed. For the construction of the vaulted roof shown in FIG. 1, the two transversely adjacent construction elements are disposed at an angle relative to one another, the cover panel elements of the two construction elements being transversely extended by a suitable distance over the ends of the associated mounting structures, to result in the formation of a sealed abutment joint 30 between the cover panel elements of adjacent roof construction elements. Sound-absorbing elements 10 and 11 of the individual construction elements are also suitably extended in the transverse direction, resulting in the formation of a continuous air passage gap extending in the transverse direction of the shed between the first and second sound-absorbing elements of the individual construction elements for the admission of fresh air to the interior of the shed as indicated by the arrows in FIG. 3. A continuous air flow passage is thus formed in each transverse array of the construction elements, resulting in a very uniform aeration of the entire volume of the shed.

The construction element according to the invention shown by way of example in FIGS.1–4 can be prefabricated preparatory to the erection of a shed, permitting considerable savings of time and cost to be achieved in the construction of noise-suppression sheds.

Figure 5:
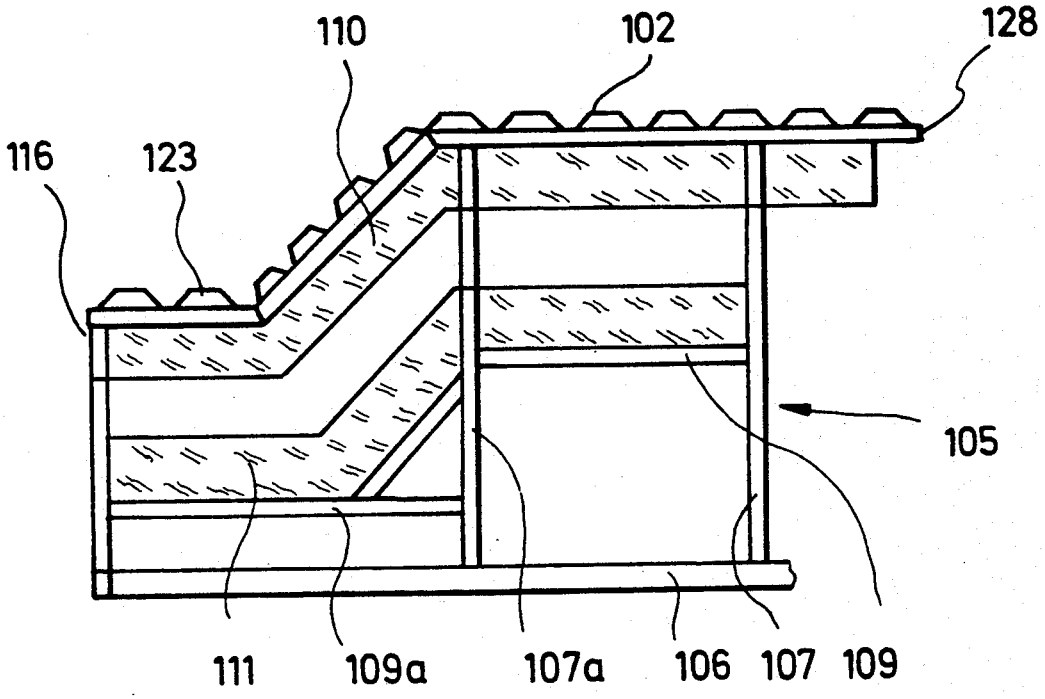
FIG. 5 shows another embodiment of a construction element according to the invention having an air passage gap of extended length.

A further embodiment of a construction element according to the invention is shown by way of example in FIG. 5, in which similar or equivalent components are designated by the same reference numerals, increased by 100, used in the figures discussed above. Here mounting structure 105 is extended to the free end 116 of lower step section 123 of cover panel element 102. This permits the construction elements to be connected to one another not only in the transverse direction, but also in the longitudinal direction of the shed, by means of their respective mounting structures rather than merely along the free end margin of the lower step section. The embodiment of a construction element shown by way of example in FIG. 5 additionally differs from the previously described construction element in that both the first sound-absorbing element 110 mounted in contact with cover panel element 102 and the facing second sound-absorbing element 111 are extended into alignment with the free end margin 116 of lower step section 123 of cover panel element 102 in the longitudinal direction of the shed, the two elements 110 and 111 having a suitably angled step profile corresponding to that of cover panel element 102 so as to ensure a substantially uniform spacing therebetween. The end of first sound-absorbing element 110 opposite the end thereof extended into alignment with the free end of lower step section 123 is also extended by a certain distance beyond the respective opposite end of mounting structure 105. For the accommodation of the extended length of second sound-absorbing element 111, mounting structure 105 is provided with two mutually offset intermediate frames 109 and 109*a*, and with a number of additional stays 107*a* for supporting the intermediate frames.

By comparison to the previously described embodiment, the construction of the embodiment shown in FIG. 5 results in a fresh-air inlet flowpath of extending length passing between sound-absorbing liners, so that an even more effective noise suppression is achieved.

We claim:

1. A construction element for forming the roof of a noisesuppression shed from a plurality of said elements connected together in the transverse and longitudinal directions of the shed, said roof having a plurality of transversely extending air inlets distributed along the longitudinal length of the roof, each construction element comprising a frame structure, a cover panel mounted on said frame structure and having two opposite spaced ends that, when said elements are connected together to form said roof, extend in the transverse direction of the shed, a first one of said ends overlapping, in the longitudinal direction of the shed and in a spaced manner, the opposite end of an adjacent construction element to form a transversely extending air inlet gap therebetween, a first liner of sound-absorbing material carried on the under side of said cover panel and a second liner of sound absorbing material carried by said frame structure and spaced from said first liner to form an air passage gap therebetween that communicates said air inlet gap with the interior of the shed.

2. The construction element of claim 1, wherein, in the longitudinal direction of the shed, said cover panel has a substantially step-shaped configuration having an upper section terminating in said first end, a lower section, lower in a vertical direction from said upper section, terminating in said opposite end and an intermediate section between said upper and lower sections, said first end of the upper section of the cover panel of one element projecting over said opposite end of the lower section of the cover panel of the next adjacent element in the longitudinal direction of the shed to form said air inlet gap therebetween when said elements are connected together.

3. The construction element of claim 2, wherein said first sound-absorbing liner extends substantially parallel to said second liner.

4. The construction element according to claim 3, wherein said second liner forms an abutment with said opposite end of the lower section of the cover panel of the next adjacent element in the longitudinal direction of the shed when said elements are connected together.

5. The construction element of claim 2, wherein said upper section extends in a plane parallel to said lower section.

6. The construction element of claim 5, wherein said intermediate section extends at an oblique angle relative to said lower and upper sections.

7. The construction element of claim 2, wherein the length of said lower section in the longitudinal direction of the shed is shorter than that of said upper section.

8. The construction element of claim 2, wherein said cover panel comprises a roofing element and a carrier frame supporting said roofing element.

9. The construction element of claim 8, wherein said roofing element is a shaped metal sheet.

10. The construction element to claim 9, wherein said shaped metal sheet has a trapezoidal profile.

11. The construction element of claim 2, wherein the sides of said first and second sound-absorbing liner facing towards each other and said air passage gap are covered by a perforated metal sheet.

12. The construction element of claim 4, wherein said first sound-absorbing liner extends over at least a portion of said upper section and of said intermediate section of said cover panel.

13. The construction element of claim 12, wherein said first sound-absorbing liner extends, in the longitudinal direction of the shed, to a location substantially in line with said abutment of the second liner with the lower section of the next adjacent construction element.

14. The construction element of claim 12, wherein said second sound-absorbing liner extends in the opposite longitudinal direction of the shed from said abutment to a location substantially in line with the boundary between said upper section and said intermediate section of said cover panel.

15. The construction element of claim 14, wherein said upper and lower sections extend in planes parallel to one another and said intermediate section extends at an oblique angle relative thereto, said opposite end of said second liner being chamfered at an angle corresponding to the oblique angle of said intermediate section of said cover panel.

16. The construction element of claim 8, wherein the frame structure comprises a rectangular frame spaced from said cover panel, and a plurality of stays connected between said rectangular frame and said carrier frame of said cover panel.

17. The construction element of claim 16, wherein said frame structure is reinforced between said cover panel and said rectangular frame by an intermediate frame and a plurality of struts extending obliquely relative to said frames.

18. The construction element of claim 17, wherein said second sound-absorbing liner is carried by said intermediate frame.

19. The construction element of claim 2, wherein in the longitudinal direction of the shed, said frame structure extends substantially from the boundary between said upper section and said intermediate section to said opposite end of the lower section of the cover panel of the next adjacent construction element in the longitudinal direction of the shed.

20. The construction element of claim 19, wherein said opposite end of the lower section of said cover panel has a shaped bar for connecting that construction element to the frame structure of the adjacent construction element in the longitudinal direction of the shed.

21. The construction element of claim 2, wherein said lower section has a rain gutter formed therein.

22. The construction element of claim 2, wherein in, the transverse direction of the shed, said construction elements are adapted to be angularly connected together to form a vaulted roof.

* * * * *